US005791913A

United States Patent [19]

Kajiwara

[11] Patent Number: 5,791,913

[45] Date of Patent: Aug. 11, 1998

[54] DISPLAY PANEL INSPECTION SOCKET

[75] Inventor: Yasushi Kajiwara, Kawaguchi, Japan

[73] Assignee: Enplas Corporation, Saitama, Japan

[21] Appl. No.: 685,753

[22] Filed: Jul. 24, 1996

[30] Foreign Application Priority Data

Jul. 24, 1995 [JP] Japan ..... 7-209250

[51] Int. Cl.[6] ..... H01R 9/09

[52] U.S. Cl. ..... 439/67; 439/493

[58] Field of Search ..... 439/67, 493

[56] References Cited

U.S. PATENT DOCUMENTS 4,060,889 12/1977 Zielinski ..... 439/67
4,289,364 9/1981 Strom et al. ..... 439/67
4,655,551 4/1987 Washizuka et al. ..... 439/67
4,993,958 2/1991 Trobongh et al. ..... 439/67

*Primary Examiner*—Neil Abrams
*Assistant Examiner*—T. C. Patel
*Attorney, Agent, or Firm*—Fish & Richardson P.C.

[57] ABSTRACT

A contact film 14 is attached to the socket body 11 for holding the substrate 2 of the display panel in a manner enabling adjustment of the position. The contact film has interconnection patterns 15 and 16 for contact with electrodes provided on the substrate of the display panel at one side. The contact film is elastically supported by the elastic supporting member 24 at the back of the interconnection pattern. The display panel is pressed by the panel pressing member 25 at the back of the electrodes. A sliding sheet 32 is interposed slidably with respect to the contact film between the elastic supporting member and contact film, so sticking of the elastic supporting member and contact film can be prevented.

6 Claims, 9 Drawing Sheets

DISPLAY PANEL INSPECTION SOCKET

BACKGROUND OF THE INVENTION

1. Field of the Invention

The present invention relates to a socket for inspection of a display panel able to be used for inspection of the quality of display of a liquid crystal display, electroluminescence panel, plasma display panel, or the like.

2. Description of the Related Art

In general, in the process of inspection of a liquid crystal display etc., the display panel before the connection of the drive IC tabs and other peripheral circuits is inspected for the quality of display etc. to detect faulty locations of the display. Accordingly, in this type of inspection, use is made of a display panel inspection device provided with contact members for contact with the electrodes arrayed on the substrate of the display panel. For example, as shown in Japanese Unexamined Patent Publication (Kokai) No. 6-08034, as the contact members for contact with the electrodes of the display panel, there have been known in the past ones comprised of needle or wire probes and a contact film comprised of an interconnection pattern for contact formed on a base film having pliability and an insulating property. Along with the increasing density of electrodes and finer pitch, however, the trend has been for use of contact films from the viewpoint of the reliability of contact with the electrodes, ease of handling, and manufacturing cost.

Japanese Patent Application No. 7-64731 by the same assignee discloses a socket for inspection of a display panel using a contact film. In this socket for inspection of a display panel, the contact film was provided to be adjustable in position with respect to the socket body. By positioning the substrate of the display panel with respect to the socket body, then aligning the position of the contact film, it was possible to align the positions of the electrodes on the substrate of the display panel and the interconnection pattern on the contact film. After this, the back surface of the contact film was pressed by a film pressing member, that is, an elastic support member, comprised of rubber or another elastomer extending in the direction of arrangement of the electrodes on the substrate of the display panel, or the back of the substrate of the display panel was pressed by a panel pressing member to bring the interconnection pattern on the contact film and the electrodes on the substrate of the display panel in contact with the necessary contact pressure.

The film pressing member comprised of rubber or another elastomer described above enabled the back surface of the contact film to be pressed uniformly, but the pressure of contact with the contact film tended to cause sticking to the back surface of the contact film and therefore when aligning the position of the contact film, the surface of the film pressing member pressing the film could stick to the back surface of the contact film and obstruct adjustment and movement of the contact film.

SUMMARY OF THE INVENTION

Accordingly, the object of the present invention is to provide a socket for inspection of a display panel enabling reliable alignment of the position of the electrodes on the substrate of a display panel and an interconnection pattern on a contact film and enabling the two to be brought into contact with a uniform contact pressure.

To achieve this object, the present invention provides a socket for inspection of a display panel provided with a socket body for holding a substrate of a display panel, a contact film attached to the socket body in a manner enabling alignment of the position and having an interconnection pattern for bringing electrodes provided on the substrate of the display panel in contact with one side, an elastic supporting member extending along the direction of arrangement of the electrodes and elastically supporting the contact film by the back surface of the interconnection pattern, a panel pressing member for pressing the substrate of the display panel at the back of the electrodes, and a sliding sheet interposed between the elastic supporting member and the contact film and able to slide with respect to the contact film.

In the socket for inspection of a display panel having this configuration, since the contact film is elastically supported by an elastic supporting member extending in the direction of arrangement of the electrodes at the back of the interconnection pattern of the contact film, when the substrate of the display panel is pressed by the panel pressing member, it is possible to easily ensure a uniform contact pressure between the interconnection pattern on the contact film and the electrodes on the substrate of the display panel. Further, since a sliding sheet which is slidable with respect to the contact film is interposed between the elastic supporting member and contact film, when aligning the position of the contact film with respect to the substrate of the display panel attached to the socket body, it is possible to prevent the movement of the contact film from being obstructed by sticking of the elastic supporting member and contact film. Accordingly, according to the present invention, it is possible to provide a socket for inspection of a display panel which can reliably align the position of the electrodes on the substrate of the display panel and the interconnection pattern on the contact film and can bring the two into contact with a uniform contact pressure.

Preferably, the sliding sheet is fastened to the socket body. In this case, there is no need for the sliding sheet to be affixed to the elastic supporting member and it is possible to easily fasten the sheet to the socket body. Also, even if the elastic supporting and pressing member comprised of the elastomer and the sliding sheet stick together, it is possible to ensure sliding of the sliding sheet and contact film, so there is greater freedom of selection of the material of the sliding sheet and it is possible to lower the cost of manufacturing the socket for inspection of a display panel.

More preferably, the elastic supporting member is enclosed by the sliding sheet and fit to a fitting portion formed on the socket body along with the sliding sheet. In this case, the sliding sheet can be easily attached to the socket body together with the elastic supporting member. Further, since the elastic supporting member is enclosed by the sliding sheet, it is possible to prevent dust and other foreign matter from depositing between the surface of the elastic sliding member pressing the film and the sliding sheet.

More preferably, the sliding sheet is affixed to the surface of the elastic sliding member pressing the film. In this case, since the sliding sheet can be stably interposed between the surface of the elastic sliding member pressing the sheet and the contact film, it is possible to easily ensure the uniform action of the elastic sliding member pressing against the contact film. Further, it is possible to prevent dust and other foreign matter from depositing between the surface of the elastic sliding member pressing the film and the sliding sheet.

Preferably, the sliding sheet is comprised of polytetrafluoroethylene or polyimide.

DESCRIPTION OF THE PREFERRED EMBODIMENTS

An explanation will be made below of preferred embodiments of the present invention with reference to the drawings.

FIG. 1 to FIG. 7 show an embodiment in the case of application of the present invention to a socket for inspection of a liquid crystal panel.

Figure 1:
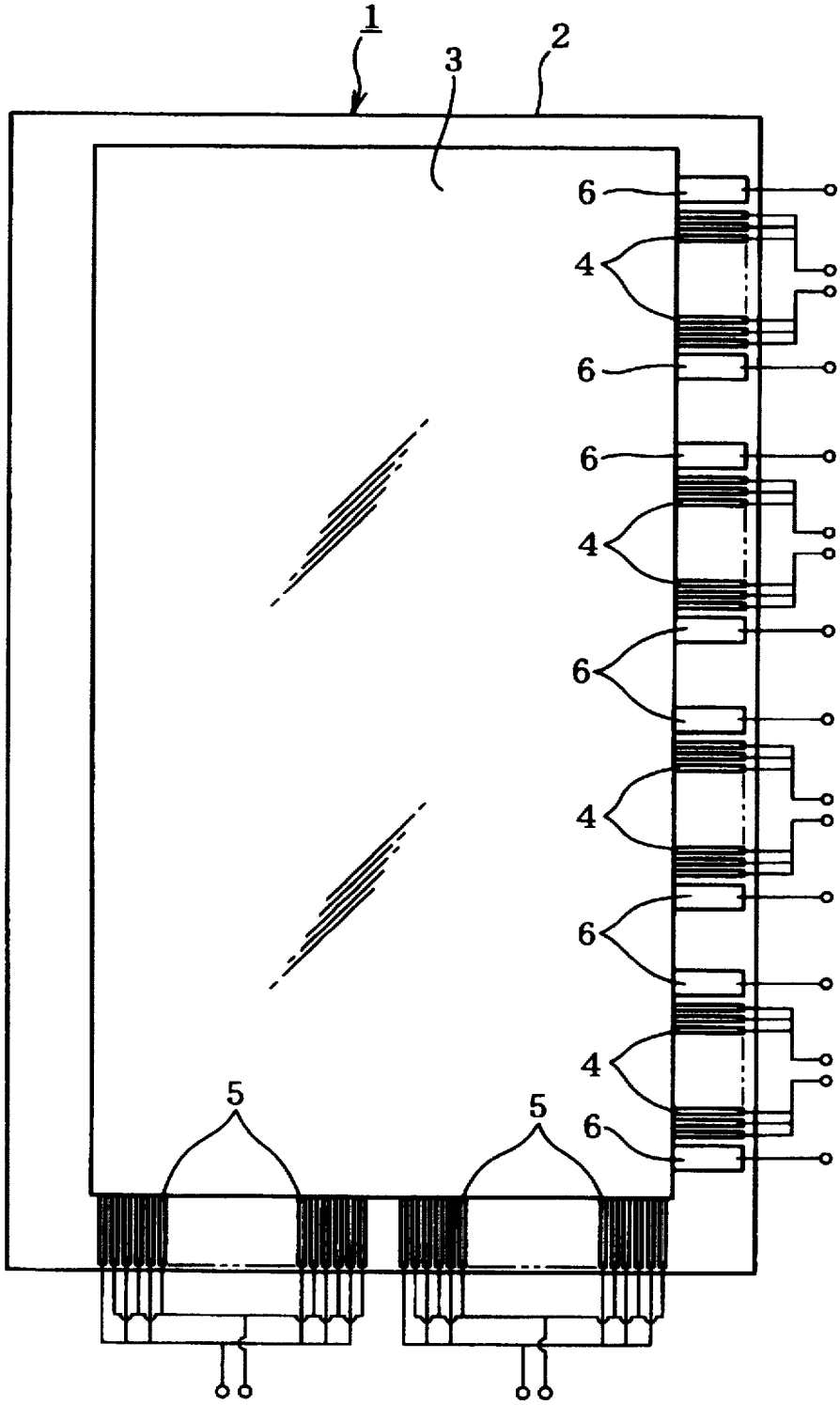
FIG. 1 is a schematic plan view of an example of the mode of supplying a signal to the electrodes on the substrate of a liquid crystal display panel.

First, referring to FIG. 1, the liquid crystal display panel 1 is comprised for example of a block-shaped insulating substrate 2 made of glass on which is formed a block-shaped liquid crystal display portion 3. A plurality of transparent electrodes 4 and 5 are arrayed in parallel on the insulating substrate 2 along the side edges of the liquid crystal display portion 3. In the example of the liquid crystal display panel illustrated, source electrodes 4 are arrayed on the insulating substrate 2 along one of the long sides of the liquid crystal display portion 3 and the gate electrodes 5 are arrayed on the insulating substrate 2 along one of the short sides of the liquid crystal display portion 3, but it is also possible to array the source electrodes on the insulating substrate along the two long sides or array the gate electrodes on the insulating substrate along the two short sides. Further, the source electrodes 4 and gate electrodes 5 of the illustrated liquid crystal display panel 1 are divided into blocks of numbers of electrodes connected to the lead terminals of a liquid crystal drive integrated circuit (not shown). Common electrodes 6 are formed positioned at the outside of the two ends of each block of the source electrodes 4.

Referring to FIG. 2 to FIG. 5, the socket 10 for inspection of a liquid crystal display panel according to an embodiment of the present invention has a socket body 11 comprised of a metal or plastic and of a substantially block shape when seen by a plane view. This socket body 11 is provided with reference engagement pieces 11*a* engaging with a corner portion of the insulating substrate 2 of the liquid crystal display panel 1. Facing the reference engagement pieces 11*a* in the diagonal direction is provided a pressing means 12 for pressing the insulating substrate 2 of the liquid crystal display panel 1 toward the reference engagement pieces 11*a*. The pressing means 12 has a movable engagement piece 12*a* engaging with the corner portion of the insulating substrate 2 and a coil spring (not shown) biasing the movable engagement piece 12*a* in the direction of the reference engagement pieces 11*a*.

Figure 2:
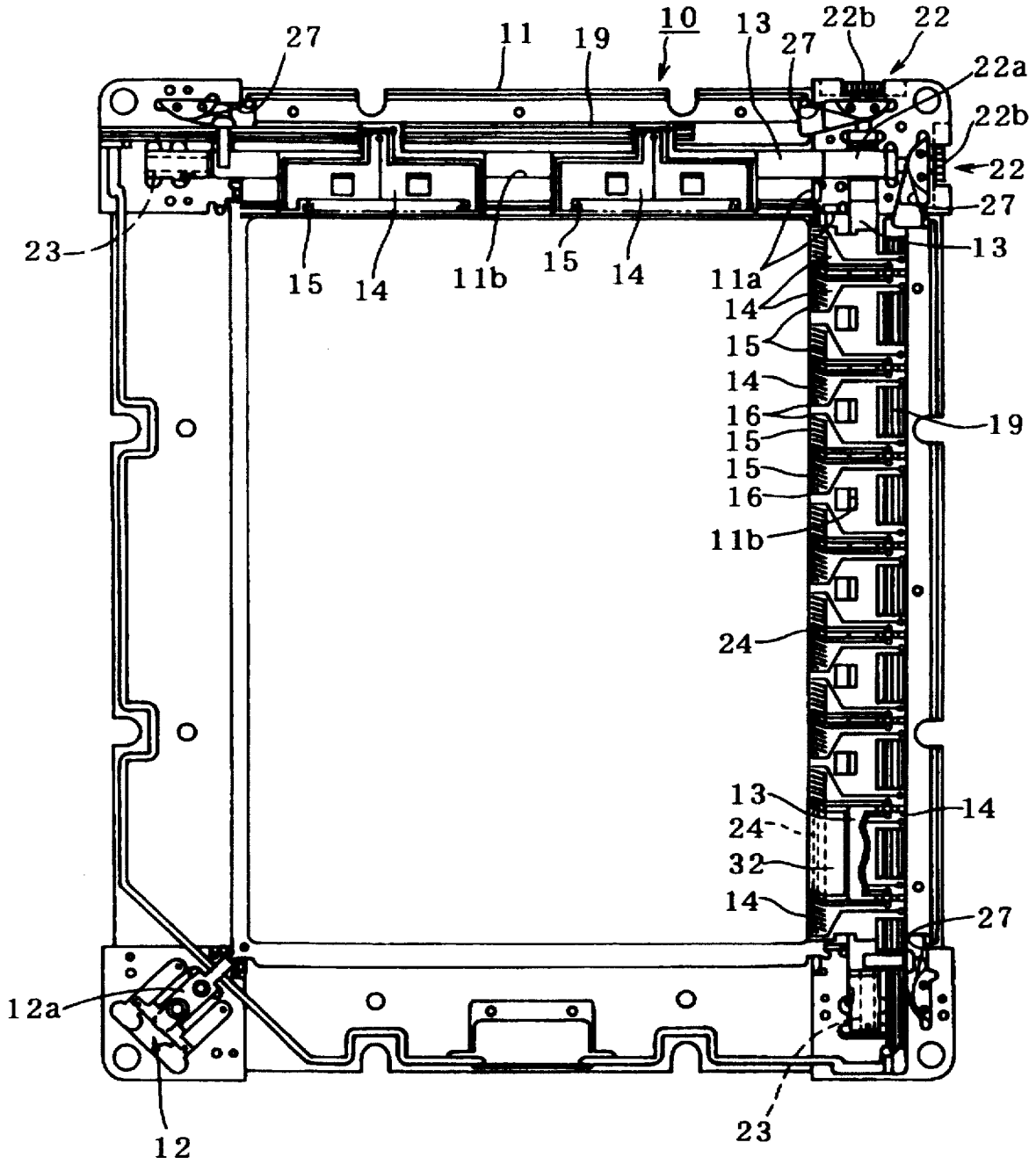
FIG. 2 is a schematic plan view of the state in the middle of assembly of a socket for inspection of a display panel used for inspection of the liquid crystal display panel of FIG. 1 in the case of application of the present invention to such a socket.
Figure 3:
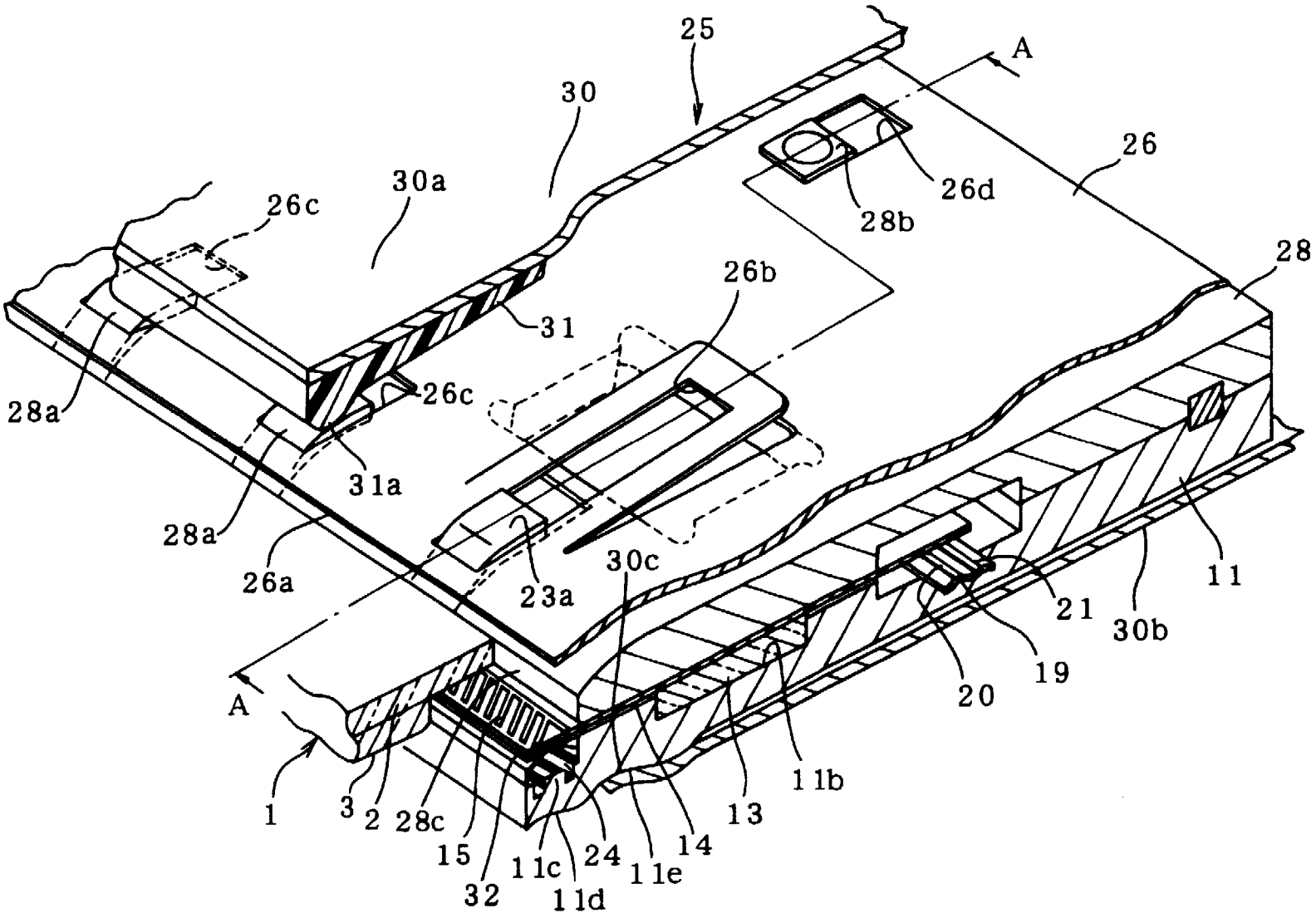
FIG. 3 is a partially cutaway perspective view of key portions of the socket shown in FIG. 2.
Figure 5:
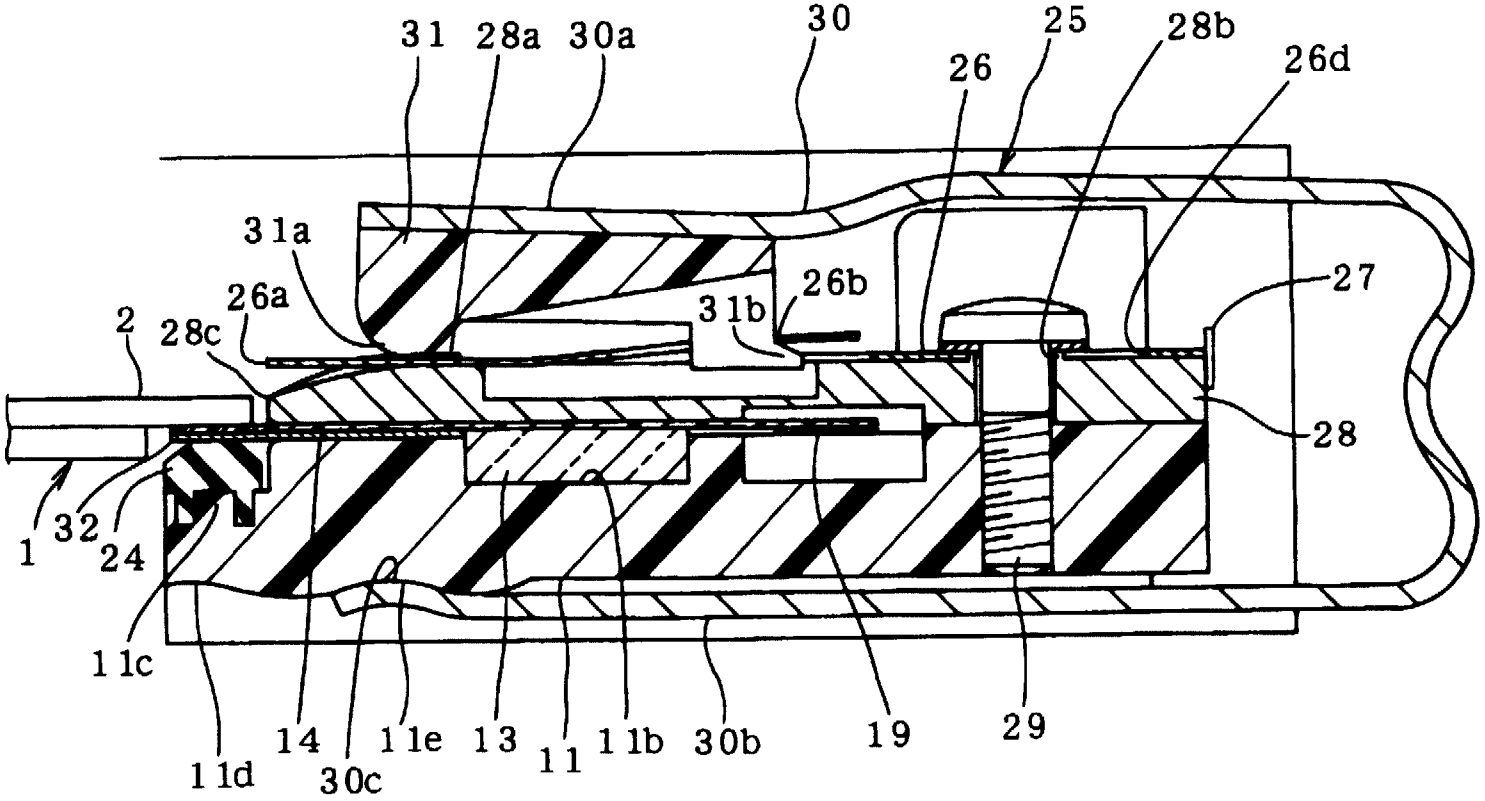
FIG. 5 is a longitudinal sectional view along the line A—A in FIG. 3 showing the state where the panel pressing member of the socket and shutter shown in FIG. 2 are retracted.
Figure 6:
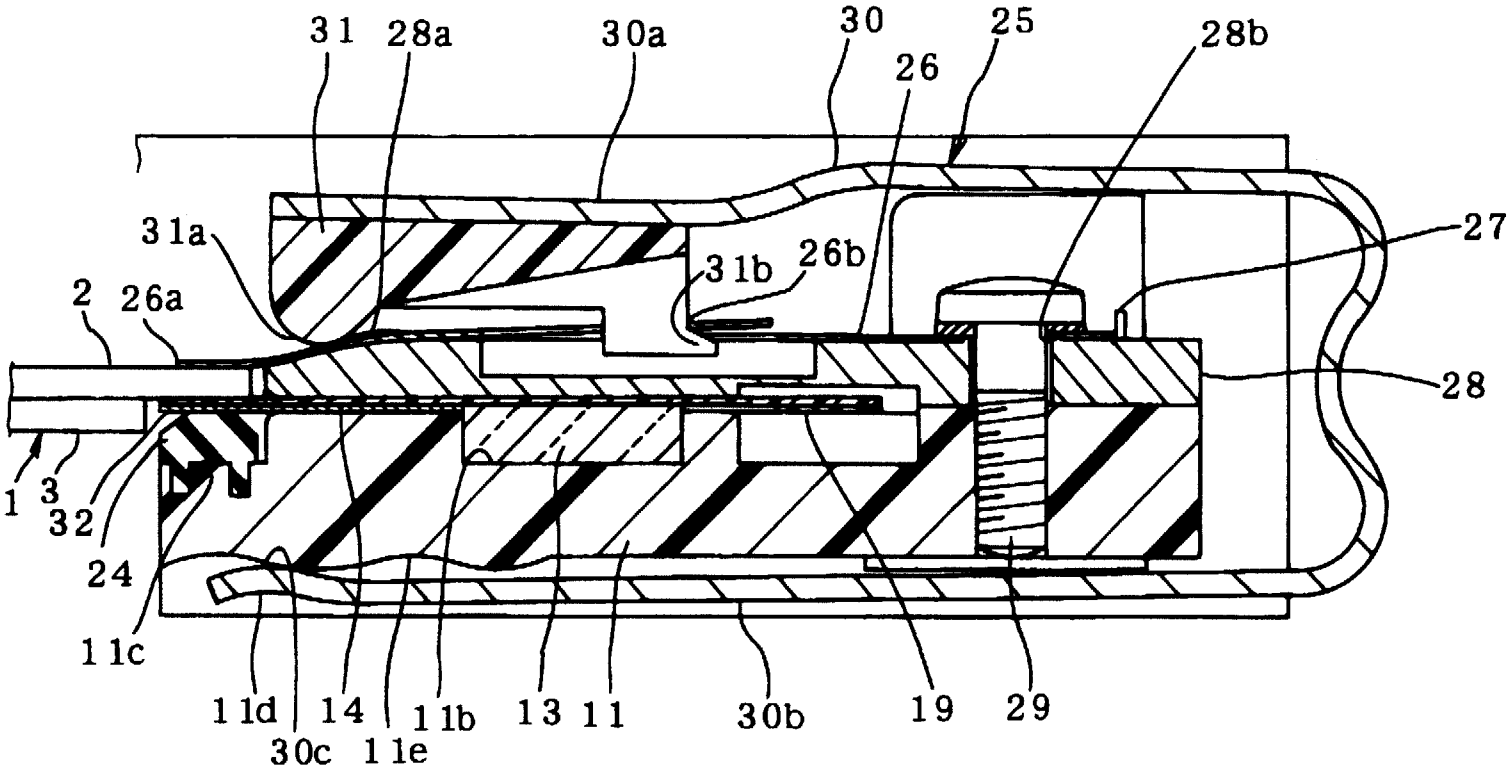
FIG. 6 is a longitudinal sectional view similar to FIG. 5 showing the state of the shutter moving forward on the substrate of the display panel before the panel pressing member of the socket shown in FIG. 2.
Figure 7:
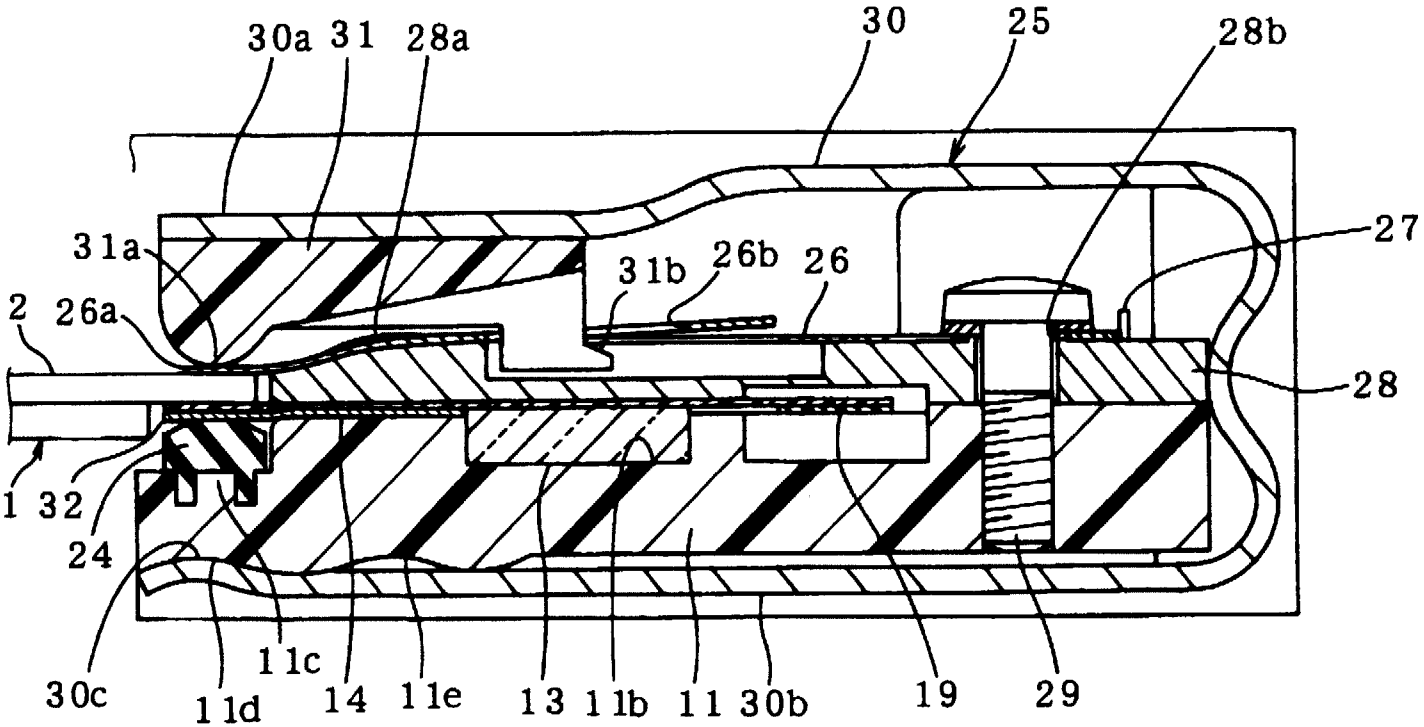
FIG. 7 is a longitudinal sectional view similar to FIG. 5 showing the state of the panel pressing member of the socket shown in FIG. 2 pressing against the top of the substrate of the display panel through the shutter.

As shown in FIG. 2, FIG. 3, and FIG. 5, grooves 11*b* extending in parallel to the side edges of the insulating substrate 2 are formed on the top surface of the socket body 11 corresponding to the side edge portions of the insulating substrate 2 of the liquid crystal display panel 1 where the transparent electrodes 4 and 5 are formed. The grooves 11*b* preferably house film attachment plates 13 made of a material having substantially the same coefficient of linear expansion as the insulating substrate 2, for example, the same material as the insulating substrate 2, so as to be displaceable by sliding in their longitudinal directions. On the top surfaces of the film attachment plates 13 are affixed a plurality of contact films 14 having pliability by for example an adhesive. The contact film 14 may be formed from various types of resins, but when the inspection socket is used for inspection of aging etc. of a liquid crystal display panel 1, the contact film is preferably formed by a resin such as a polyimide which can withstand an ambient temperature of 80° to 100° C.

Figure 4:
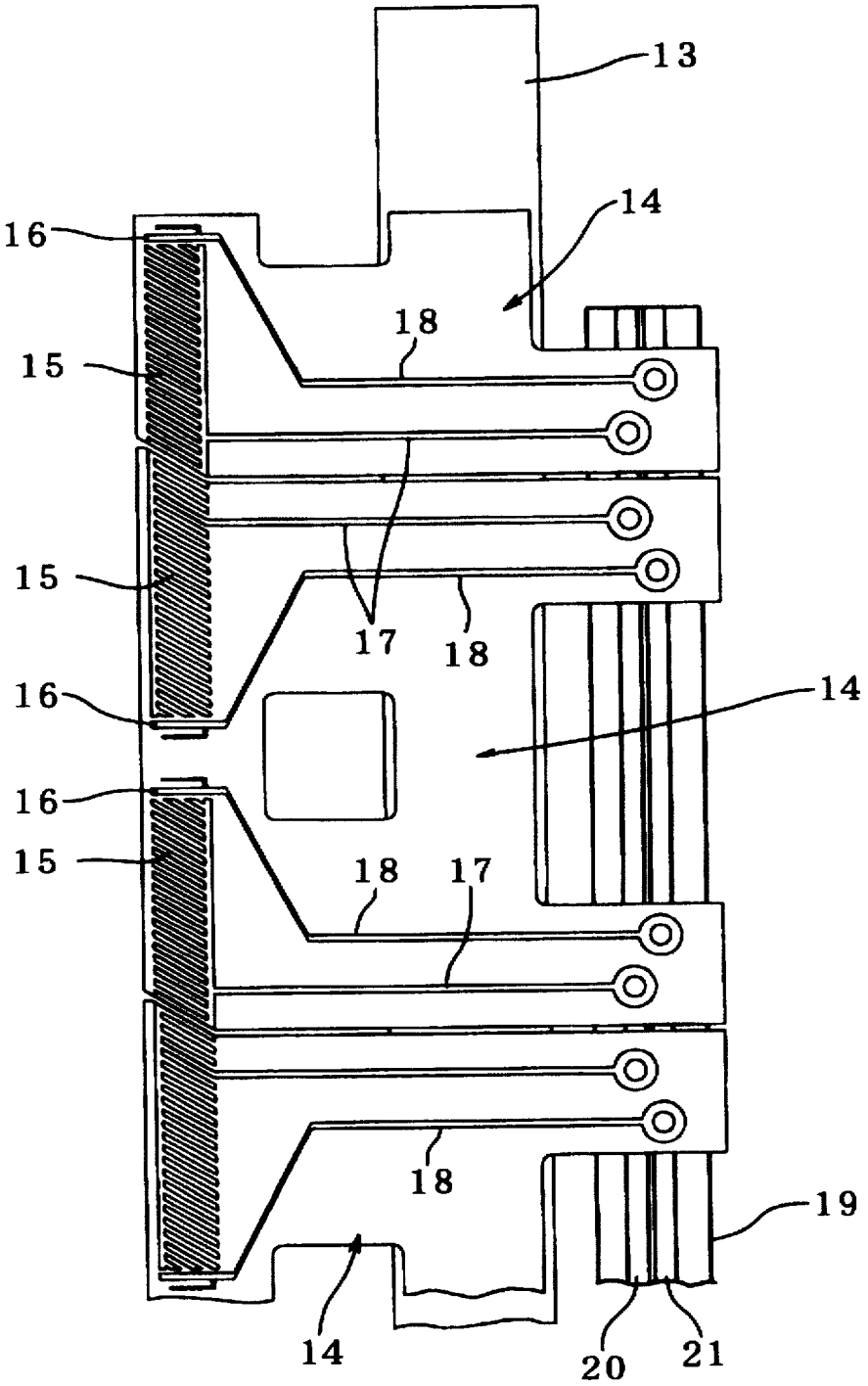
FIG. 4 is a plan view of key portions showing the state of arrangement of the contact film of the source side on a film attachment plate of the socket shown in FIG. 2.

FIG. 4 shows the contact film 14 used for contact with the source electrodes 4. On the top surface of the contact film 14 is formed the interconnection pattern 15 for contact with the source electrodes 4 of the liquid crystal display panel 1 and the interconnection pattern 16 for contact with the common electrodes 6. These interconnection patterns 15 and 16 are connected through the lead patterns 17 and 18 with the interconnection patterns 20 and 21 of the flexible printed circuit board 19. The interconnection pattern 15 is formed so as to cross the transparent electrodes 4 of the liquid crystal display panel 1 at an angle, but this is only one example. For example, it may be formed to diagonally intersect the transparent electrodes 4. Note that the contact film 14 used for contact with the gate electrodes 5 and the contact film 14 used for contact with the source electrodes 4 differ only in the shape of the interconnections of the interconnection pattern. The configuration of the structure for attachment enabling positional alignment of the film attachment plate 13 with the transparent electrodes 5 by adjustment of the position, the structure for pressing the bottom surface of the front end (back surface) by the elastic sliding member, that is, the film pressing member 24, are similar. Below, a more detailed explanation will be made of the contact film 14 of the source side. A detailed explanation of the contact film 14 of the gate side will be omitted.

At one end of each of the grooves 11*b* is provided an attachment plate position adjusting means for positioning one end of the film attachment plate 13 on the same reference plane as the end of the insulating plate 2 of the liquid crystal display panel 2. This attachment plate position adjusting means 22 has an abutment piece 22*a* for abutting against one end of the film attachment plate 13 and an adjustment screw 22*b* for adjusting the position of the abutment piece. The other end of each groove 11*b* is provided with a coil spring 23 for abutting against the other end of the film attachment plate 13 and pressing the film attachment plate 13 against the abutment piece 22a of the attachment plate position adjusting means 22.

As shown in FIG. 2, FIG. 3, and FIG. 5, the attachment portion 11*c* formed on the socket body 11 has attached to it the elastic sliding member 24 for pressing the bottom surface (back surface) of the front end portion of the contact film 14 on the side opposite to the interconnection patterns 15 and 16. This elastic sliding member 24 extends along the direction of arrangement of the transparent electrodes 4 so as to press part of the transparent electrodes 4 on the insulating substrate 2 of the liquid crystal display panel 1 through the contact film 14. The elastic sliding member 24 can be formed by various types of rubber or rubbery elastomers, but when the inspection socket is used in inspections of aging etc. of the liquid crystal display panel 1, the elastic sliding member 24 preferably is formed by for example silicone rubber able to withstand an ambient temperature of 80° to 100° C.

Further, the socket 10 is provided with a panel pressing member 25 provided slidably with respect to the socket body 11 when pressing the insulating substrate 2 of the liquid crystal display panel 1 against the contact film 14 when moving to the top surface of the insulating substrate 2 of the liquid crystal display panel 1 carried on the contact film 14 and a pliable shutter 26 interposed between the panel pressing member 25 and insulating substrate 2 of the liquid crystal display panel 1 when the panel pressing member 25 presses the insulating plate 2 of the liquid crystal display panel 1. Further, the socket body 11 has attached to it a spring 27 (see FIG. 2) for biasing the rear end of the shutter 26 forward. The shutter 26 can move from a retracted position (see FIG. 3 and FIG. 5) where the front end 26*a* opens the region carrying the liquid crystal display panel by the biasing force of the spring 27 to a covering position (see FIG. 6 and FIG. 7) where the front end 26*a* covers the top of the insulating substrate 2 of the liquid crystal display panel 1. At the socket body 11, the supporting plate 28 covering the top of the contact film 14 and with a front end extending along the side edge of the insulating substrate 2 of the liquid crystal display panel 1 is fastened by screws 29. The shutter 26 is supported slidably on the support plate 28.

As shown in FIG. 3 and FIG. 5, the panel pressing member 25 of this embodiment is comprised of a lateral U-sectional shaped metal damper 30 having a spring property attached to the socket body 11 so as to grip the socket body 11 and the insulating substrate 2 of the liquid crystal display panel 1 from the top and bottom and a plastic sliding piece 31 extending over substantially the entire length of the top piece 30*a* of the damper 30, screwed for example on the bottom surface of the top piece 30*a*, and sliding on the top surface of the shutter 26. As the plastic material used for the sliding piece 31, a material such as polytetrafluoroethylene having slidability is preferred. The sliding piece 31 has a projecting portion 31a forming a portion pressing the front end of the panel pressing member 25. Further, the sliding piece 31 is provided with a contact portion 31*b* contacting the engagement portion 26*b* of the shutter 26 when retracting from the pressing position (see FIG. 7) where the projection portion 31*a* presses the insulating substrate 2 of the liquid crystal display panel 1 to the open position (see FIG. 6) opening the region carrying the liquid crystal display panel. When the panel pressing member 25 retracts further from the open position, the shutter 26 is moved from the covering position to the retracted position (see FIG. 5) against the biasing force of the spring 27 by the contact portion 31*b*.

As shown in FIG. 3 and FIG. 5, on the top surface of the supporting plate 28 there is provided in a projecting fashion a guide portion 28*a* which abuts against the bottom surface of the front end of the panel pressing member 25 and moves the panel pressing member 25 away from the top surface of the contact film 14 when the panel pressing member 25 is moving between the open position and retracted position. Further, on the top surface of the supporting plate 28 there are provided in a projecting fashion a plurality of bosses 28*b* through which screws 29 pass. The guide portion 28*a* and bosses 28*b* of the supporting plate 28 engage slidably with the elongated holes 26*c* and 26*d* formed in the shutter 26. The shutter 26 can be moved forward to the covering position by the rear ends of the elongated holes 26*d* abutting against the bosses 28*b* of the supporting plate 28.

Further, the top surface of the supporting plate 28 has substantially the same height as the top surface of the side edge of the insulating substrate 2 of the liquid crystal display panel 1 at the front end 28*c* near the side edge of the insulating substrate 2 of the liquid crystal display panel 1 carried on the contact film 14. The top surface of the supporting plate 28 is inclined downward gently as it heads from near the guide portion 28*a* to the front end 28*c*.

Further, in this embodiment, as shown in FIG. 3 and FIG. 5, the front end of the bottom piece 30*b* of the damper 30 is bent to form the upward facing projection 30*c*. At the bottom surface of the socket body 11 there are formed the depressions 11*d* and 11*e* elastically engaging with the projection 30*c* of the damper 30 when the panel pressing member 25 is at the pressing position (FIG. 7) and retracted position (FIG. 5). Accordingly, it is possible to stably engage the panel pressing member 25 at the pressing position and retracted position. Note that the slide operation of the damper 30 is preferably performed using a jig (not shown).

Further, in this embodiment, as shown in FIG. 3 and FIG. 5, to avoid direct contact between the rubber or other elastomer elastic sliding member 24 and bottom surface (back surface) of the contact film 14, the sliding sheet 32 characterizing the present invention is interposed between the surface of the elastic sliding member 24 pressing the film and the bottom surface of the contact film 14. This sliding sheet 32 is fastened to the socket body 11 by an adhesive (not shown), but it is also possible to attach it on the socket body 11 by setscrews etc. in a detachable manner. The sliding sheet 32 is formed by a material such as polytetrafluoroethylene and polyimide which has great pliability and slidability with respect to the contact film 14.

In the socket 10 for inspection of a liquid crystal display panel of the above configuration, since the back surface (bottom surface) of the contact film 14 is pressed by a film pressing member 24 comprised of an elastomer extending in the direction of arrangement of the transparent electrodes 4 and 5, it is possible to easily ensure a uniform contact pressure between the interconnection patterns 15 and 16 on the contact films 14 and the transparent electrodes 4, 6, 5, etc. on the insulating substrate 2 of the liquid crystal display panel 1. Further, since the sliding sheet 32 having pliability and slidability is interposed between the elastic sliding member 24 comprised of rubber or another elastomer and the back surface of the contact film 14, when positioning the contact film 14 with respect to the insulating substrate 2 of the liquid crystal display panel 1 attached to the socket body 11, it is possible to prevent the movement of the contact film 13 being obstructed by the adhesion of the rubber or other elastomer elastic sliding member 24 and contact film 14. Accordingly, it is possible to easily and reliably align the positions of the electrodes 4, 6, 5, etc. on the insulating substrate 2 of the liquid crystal display panel 1 and the interconnection patterns 15 and 16 etc. on the contact film 14.

Further, according to the configuration of the above embodiment, there is no need to affix the sliding sheet 32 to the rubber or other elastomer elastic sliding member 24. Further, even if the rubber or other elastomer elastic sliding member 24 and sliding sheet 32 stick, it is possible to ensure the slidability of the sliding sheet 32 and contact film 14, there is greater freedom of selection of the material of the sliding sheet 32 and it is possible to lower the cost of manufacturing the socket for inspection of a display panel.

Figure 8:
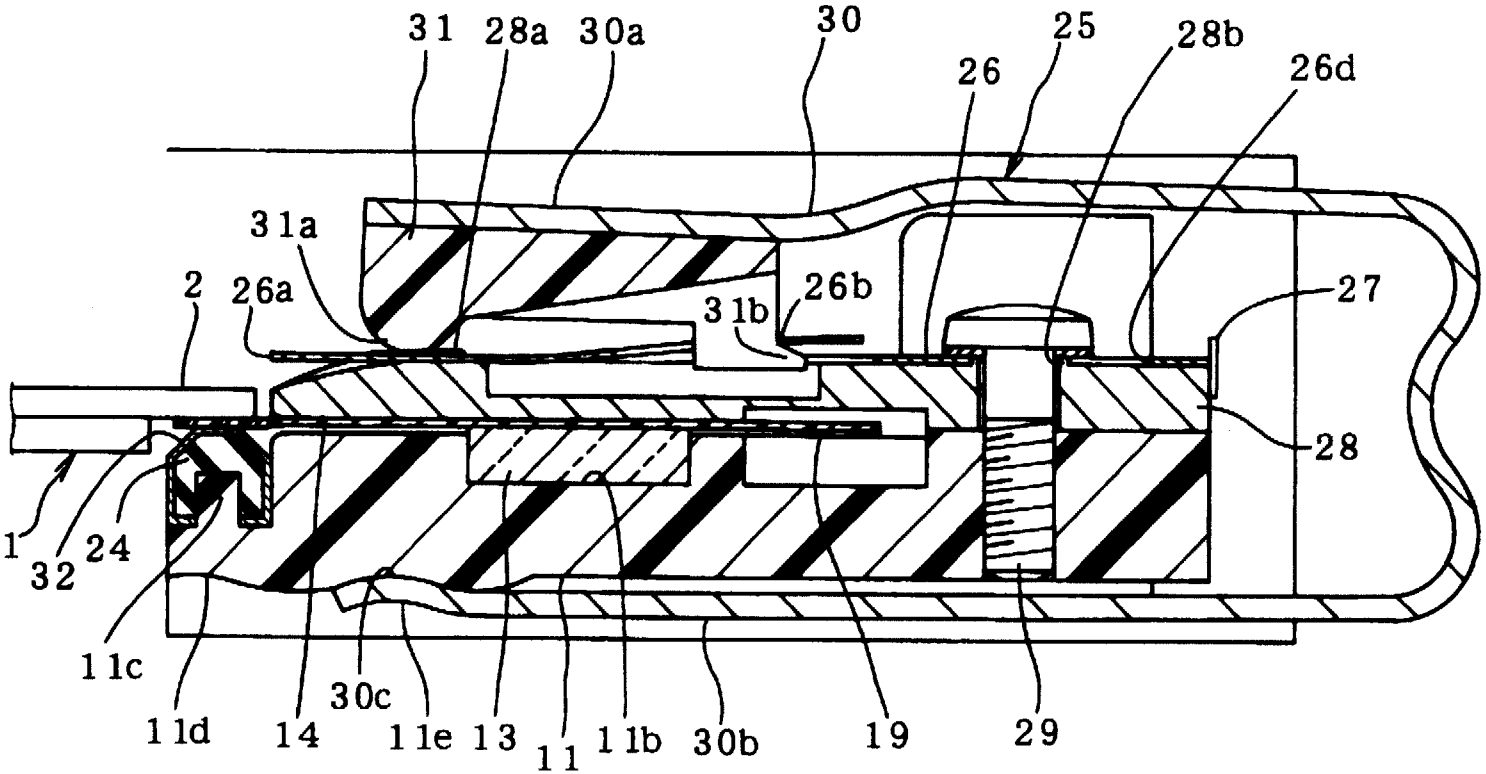
FIG. 8 is a longitudinal sectional view similar to FIG. 5 showing another embodiment of the present invention.
Figure 9:
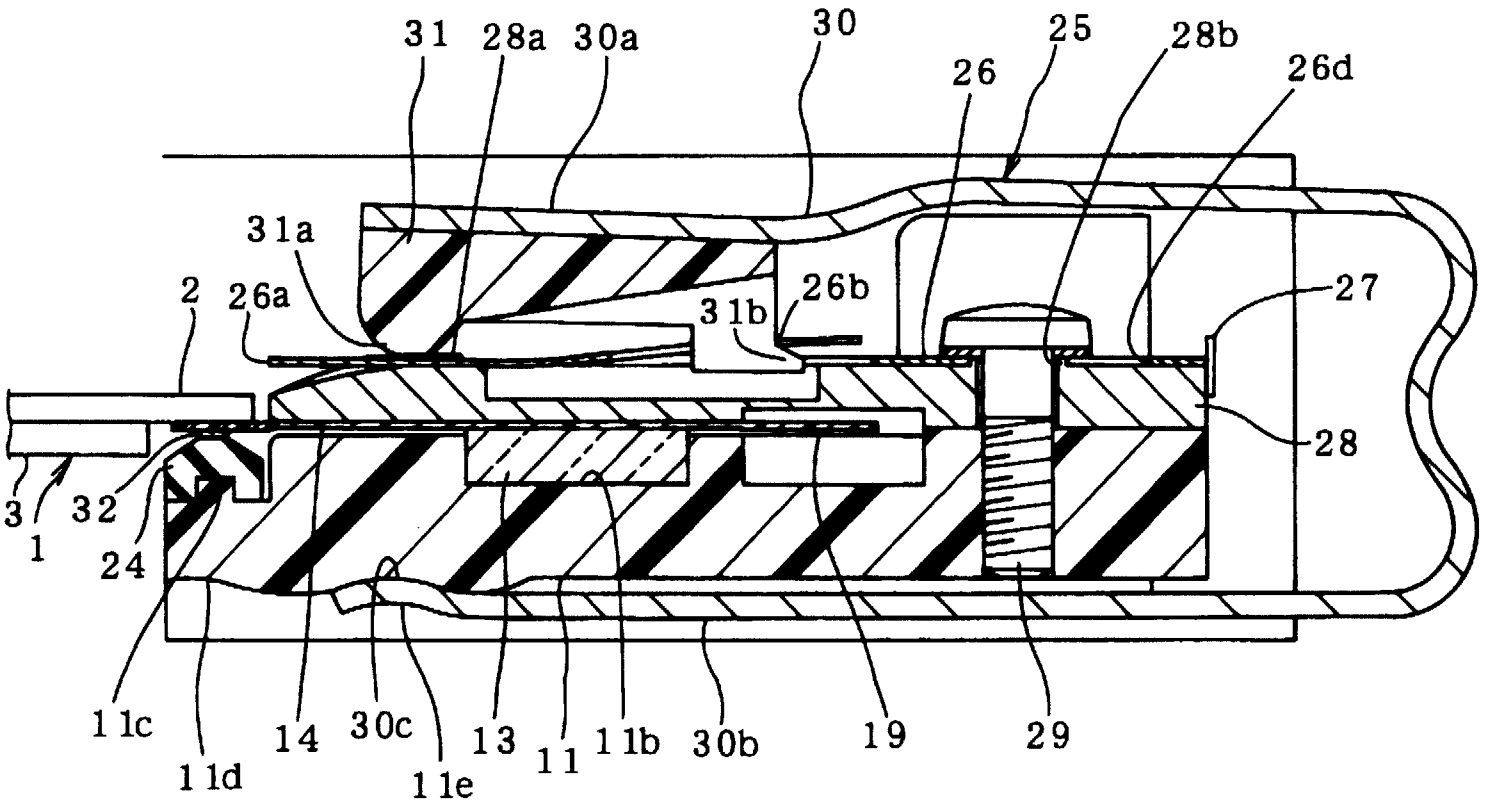
FIG. 9 is a longitudinal sectional view similar to FIG. 5 showing still another embodiment of the present invention.

FIG. 8 and FIG. 9 show other embodiments of the present invention. In these figures, the same reference numerals are given to components similar to those in the above embodiment.

In the embodiment of FIG. 8, the elastic sliding member 24 comprised of rubber or another elastomer for pressing the back surface of the contact film 14 is enclosed by the sliding sheet 32 and attached to an attachment portion formed on the socket body 11 together with the sliding sheet 32. The rest of the configuration is similar to that of the above embodiment. Further, the sliding sheet 32, like in the above embodiment, can be formed of a resin such as polytetrafluoroethylene or polyimide. Accordingly, in the case of the embodiment of FIG. 8, like with the above embodiment, it is possible to ensure the slidability of the sliding sheet 32 and contact film 14 and possible to easily fasten the sliding sheet 32 to the socket body 11 together with the elastic sliding member 24. Further, since the elastic sliding member 24 is enclosed by the sliding sheet 32, it is possible to prevent the deposition of dust or other foreign matter between the surface of the elastic sliding member 24 pressing the film and the sliding sheet 32.

The embodiment of FIG. 9 is characterized in that the sliding sheet 32 having pliability and slidability is affixed to the surface of the rubber or other elastomer elastic sliding member 24 pressing the film by for example an adhesive. The rest of the configuration is the same as that of the above embodiment. Further, the sliding sheet 32, like in the above embodiment, may be formed by a resin such as polytetrafluoroethylene or polyimide. In the case of the embodiment of FIG. 9, like in the above embodiment, it is possible to ensure the slidability of the sliding sheet 32 and the contact film 14 and stably interpose the thin sliding sheet 32 between the surface of the elastic sliding member 24 pressing the film and the back surface of the contact film 14, so it is possible to easily ensure a uniform action by the rubber elastic sliding member 24 pressing the contact film 14. Further, it is possible to prevent deposition of dust or other foreign matter between the surface of the elastic sliding member 24 pressing the film and the sliding sheet 32.

While the invention has been explained using illustrated embodiments, the present invention is not limited to the embodiments discussed above. Various modifications may be made to the types, numbers, etc. of the components within the scope of the claims. For example, the shutter 26, as disclosed in Japanese Patent Application No. 7-64731, may be configured so as to move away from the top surface of the insulating substrate 2 of the liquid crystal display panel 1 and move out of the region carrying the liquid crystal display panel due to bending upward. Further, the panel pressing member may be configured to be pivoted at the socket body 11 to be able to open and close. Further, the above embodiments are configured so that the elastic sliding member 24 is affixed to the socket body 11 and the panel pressing member 30 can move with respect to the socket body 11, but it is also possible to affix the panel pressing member to the socket body 11 and make the elastic sliding member movable with respect to the socket body 11.

Further, in the illustrated embodiment, the explanation was made of placing the liquid crystal display panel 1 on the top surface of the contact film 14 from the top, but it is also possible to make the interconnection pattern 15 of the contact film face downward and arrange the substrate 2 of the liquid crystal display panel 1 to come into contact with the contact film 14 from the bottom of the socket body 11.

Further, in the illustrated embodiment, use is made of a film pressing member 24 of a substantially trapezoidal sectional shape and solid structure comprised of rubber or another elastomer, but the invention is not limited to this. One formed into a substantially reverse U-sectional shape, one formed with an upside-down hollow portion, etc. may also be used. Further, it is possible to form a plurality of projections at the top of the elastic sliding member 24 so as to press the contact film at a plurality of locations against the transparent electrodes.

Further, the present invention can be similarly applied to a socket for inspection of not only a liquid display panel, but also an electroluminescence panel, plasma display panel, etc.

I claim:

1. A socket for inspection of a display panel, comprising:

a socket body for holding in place a substrate of a display panel that has electrodes;

a contact film having at one side thereof an interconnection pattern of conductors which is to be brought into contact with said electrodes provided on said substrate of said display panel;

an elastic supporting member extending along a direction of arrangement of said electrodes and elastically supporting said contact film by the back of said interconnection pattern;

a panel pressing members pressing force against said substrate of said display panel by the back of said electrodes;

a sliding sheet interposed between said elastic supporting member and said contact film and able to slide with respect to said contact film; and adjustable holding means for movably holding said contact film, and adjusting a position of said contact film with respect to said substrate of said display panel by sliding said contact film with respect to said substrate and said sliding sheet when said contact film and said sliding sheet are gripped between said elastic supporting member and said substrate and not being pressed by said panel pressing member.

2. A socket for inspection of a display panel as set forth in claim 1, wherein said sliding sheet is affixed to the surface of said elastic supporting member pressing the film.

3. A socket for inspection of a display panel as set forth in claim 1, wherein said sliding sheet is comprised of polytetrafluoroethylene.

4. A socket for inspection of a display panel as set forth in claim 1, wherein said sliding sheet is comprised of a polyimide.

5. A socket for inspection of a display panel as set forth in claim 1, wherein said sliding sheet is fastened to said socket body.

6. A socket for inspection of a display panel as set forth in claim 5, wherein said elastic supporting member is enclosed by said sliding sheet and is attached to an attachment portion formed on said socket body along with said sliding sheet.

* * * * *